United States Patent [19]

Schimko

[11] Patent Number: 4,712,391

[45] Date of Patent: Dec. 15, 1987

[54] FLAT KNITTING MACHINE

[75] Inventor: Reinhold Schimko, Aalen-Wasseralfingen, Fed. Rep. of Germany

[73] Assignee: Universal Maschinenfabrik Dr. Rudolf Schieber GmbH & Co. KG, Fed. Rep. of Germany

[21] Appl. No.: 39,133

[22] Filed: Apr. 16, 1987

[30] Foreign Application Priority Data

Apr. 16, 1986 [DE] Fed. Rep. of Germany ..... 3612836

[51] Int. Cl.[4] ..... D04B 15/00

[52] U.S. Cl. ..... 66/115; 66/123

[58] Field of Search ..... 66/114, 115, 123

[56] References Cited

U.S. PATENT DOCUMENTS 4,610,150 9/1986 Hiromoto et al. ..... 66/115

4,649,721 3/1987 Goller et al. ..... 66/115

*Primary Examiner*—Ronald Feldbaum

*Attorney, Agent, or Firm*—Sughrue, Mion, Zinn, Macpeak & Seas

[57] ABSTRACT

A flat knitting machine has a needle selection arrangement movable along its needle bed, knitting needles arranged in needle channels of the needle bed and selector drivers or a tandem arrangement of working drivers and selector drivers adjoining the knitting needles in the needle channels, which cooperate with the needle selection arrangement. In order to achieve drivers of uniform weight with the same acceleration effect for differing gauges of the flat knitting machine, distance plates are fixed and inserted on at least one side of the drivers in the needle channels extending substantially along the length of the working drivers and/or selector drivers, the width of the distance plates being equal to the difference between the width of the needle channels and the width of the working drivers and/or selector drivers.

9 Claims, 3 Drawing Figures

FLAT KNITTING MACHINE

The invention relates to a flat knitting machine comprising a needle selection arrangement movable across the needle bed thereof, knitting needles arranged in needle channels of the needle bed and selector drivers or a tandem arrangement of working drivers and selector drivers which are adjacent the knitting needles in the needle channels and cooperate with the needle selection arrangement.

Every activation of a driver requires a force whose magnitude is primarily dependent upon the weight of the driver. In order that the drivers do not rebound upon movement by the selector mechanism, they are strongly braked to a greater or lesser extent. Such a braking effect may be achieved inter alia by lateral bending of the drivers away from their longitudinal axes. In this connection it is important that the spring characteristic of the bending is flat so that the braking effect of the bending on the drivers is not severe but rather weak. A further measure for preventing rebound of the drivers consists in that the inclined drive surfaces of the selector mechanism, particularly in rapidly operating flat knitting machines are made flat so that the acceleration of the drivers can be maintained correspondingly low.

With the various gauges of flat knitting machines, needle channels of varying widths are provided and correspondingly require drivers of differing widths. Now in order to achieve uniform braking elasticity by lateral bending of the drivers with the differing gauges, the drivers of larger gauge are provided with notches of various depths so that the remaining material thickness in the region of the bend remains constant with the differing gauges. Although a uniform spring characteristic thus results, the acceleration effect is however nevertheless different in dependence upon the weight of the driver.

From CH-PS No. 369 854, it is known to clad both side walls of the needle channels with elastically deformable guide plates which are fixed in the needle bed and extend over its entire width. The needle channels in this constructions are also of differing width in the event of differing gauges.

The invention is based on the object of providing a flat knitting machine of the type described in the introduction in which with differing gauges of the machine the drivers have both a uniform elasticity in the braking force and also uniform weight and thus have a uniform acceleration effect.

This object is achieved according to the invention in that the width of the working drivers and/or selector drivers is smaller than the width of the needle channels, and in that in the needle channels distance plates are inserted and fixed on at least one side of the drivers, the plates extending substantially along the length of the working drivers and/or selector drivers and having a width equal to the difference between the width of the needle channels and the width of the working drivers and/or selector drivers.

In this way, the width of the operating and selector drivers can be selected independently of the gauge of the flat knitting machine and of the width of its needle channels and thus of their weight. The distance plates are fixed in the needle channels and do not contribute decisively to the movement and braking behaviour of the drivers.

Advantageously, with a width of the needle channels and the knitting needles adapted to the gauge of the flat knitting machine, the width of the working drivers and/or selector drivers is uniformly constant and the width of the distance plates is accordingly different for differing gauges of the flat knitting machine. Thus, over a wide range of differing gauges, working drivers and/or selector drivers of constant weight and thus uniform braking and rebound behaviour can be achieved. For the differing gauges of the flat knitting machine, drivers of only a single thickness are to be provided; equalisation for the differing needle channel widths is achieved by the fixed inserted distance plates.

Expediently, the surfaces of the distance plates extend in and below the surfaces of the needle bed, beneath the surfaces where holding rails for holding the knitting needles and drivers in the needle bed are provided.

Advantageously, in each case a single distance plate is inserted along the length of the working driver and selector driver in the needle channel. This simplifies both the manufacture and also the insertion and fixing of the distance plates in the needle channel.

Expediently, each distance plate is fixed by a rail extending transversely of the needle channels in the needle bed and in form-locking engagement to prevent movement in the movement direction of the working driver and/or selector drivers.

With appropriate construction of the knitting needles, the distance plate is advantageously constructed in such manner that it partially overlaps these in the region of the working drivers or selector driver.

The distance plates are expediently inserted on only one side of the working driver and/or selector driver. Alternatively, the distance plates can also be inserted on both sides of the working driver and/or selector driver, which can be advantageous particularly with large gauges of the flat knitting machine.

With gauge E3 of the flat knitting machine, the width of the knitting needles expediently amounts to for example 2.2 mm, the width of the working driver and/or selector driver amounts to 1 mm, and the width of the distance plates is 1.2 mm.

The invention is explained in more detail in the following on the basis of an exemplary embodiment and with reference to the drawing, in which.

Figure 1:
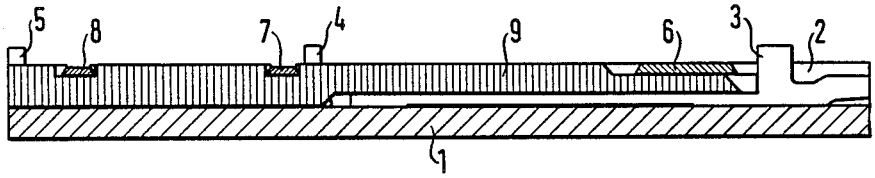
FIG. 1 shows a cross-section through a needle bed of a flat knitting machine with inserted drivers and distance plates according to the invention, along the section line I.I of FIG. 3.
Figure 2:
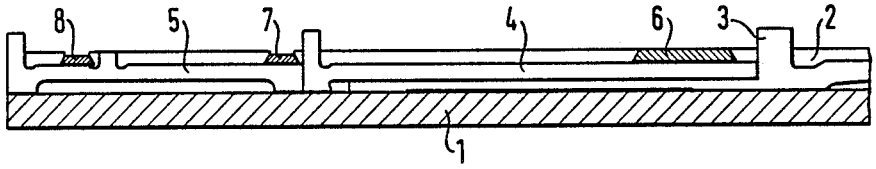
FIG. 2 shows a cross section as in FIG. 1 but however along the section II—II of FIG. 3.
Figure 3:
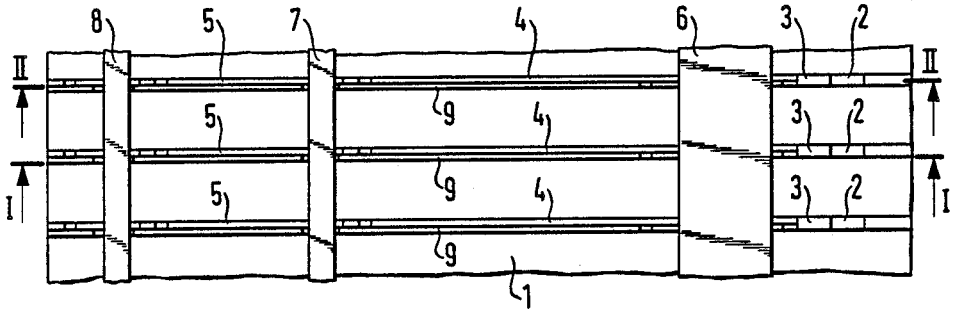
FIG. 3 shows a plan view of a portion of a needle bed according to FIG. 1.

As illustrated in FIGS. 1 to 3, a needle bed 1 of a flat knitting machine has needle channels 2 arranged and constructed according to the gauge of the flat knitting machine. In each needle channel is arranged a knitting needle 3 and adjacent to this an working driver 4. The working driver 4 is releasably engaged with the knitting needle 3 and partially overlaps the same. Behind the working driver and releasably engaged with this is arranged a selector driver 5 in the needle channel 2. The working driver 4 and selector driver 5 can also be combined to form a unitary selector driver.

The knitting needles 3, working drivers 4 and selector drivers 5 are held in the needle channels 2 of the needle bed 1 by rails 6,7,8 extending transversely of the needle channel 2.

On one side of the working driver 4 and selector driver 5 is inserted a distance plate 9 extending substantially along the length of the working driver 4 and selector driver 5. The distance plate 9 is cross-hatched in FIG. 1 for better visibility. By means of the rails 7 extending transversely of the needle channels 2, which rails engage in a corresponding rectangular groove in the distance plate 9, the distance plate 9 is fixed in a form-locking manner against motion in the movement direction of the working driver 4 and selector driver 5 and thus does not take part in the two and fro movements of the working driver 4 and the selector driver 5 under the influence of the needle selection arrangement which is not illustrated.

The width of the working driver 4 and selector driver 5 can now be so selected that for example they correspond to the width of a needle channel 2 for the finest desired gauge of a flat knitting machine. For larger gauges of the flat knitting machine, the width difference between the needle channel width and driver width is then equalised by appropriately selected width of fixed distance plates 9 which do not take part in the driver movement. The weight of the working driver 4 and selector driver 5 can thus remain always the same independently of the graduation or gauge of the flat knitting machine.

Instead of the distance plates 9 illustrated in the drawings which extend substantially over the entire length of the working driver 4 and selector driver 5, also two distance plates arranged behind one another can be used, which extend respectively substantially along the length of the working driver 4 and the length of the selector driver 5. In the drawings, is illustrated a distance plate 9 inserted on one side of the working driver 4 and the selector driver 5 in the needle bed 2. It can however also be advantageous to insert a distance plate on both sides of the working driver 4 and the selector driver 5 in each needle channel 2.

According to a particular exemplary embodiment of the flat knitting machine, the needle channel 2 is 2.2 mm wide with a gauge E3 of the flat knitting machine. The knitting needle 3 has a width of 2.2 mm, and the working driver 4 and selector driver 5 arranged behind the knitting needle 3 have a thickness of 1 mm. The distance plate 9 extending in this case along the region of the working driver 4 and the selector driver 5 then has a width of 1.2 mm corresponding to the difference between the needle channel width and the driver width. In this way, the weight of the working drivers 4 and 5 is only about 45% of the weight of conventional drivers with a thickness of 2.2 mm. As a result of this weight saving, the working drivers 4 and selector drivers 5 will rebound less strongly at the start of movement in cooperation with the needle selection arrangement.

What is claimed is:

1. Flat knitting machine having a needle bed and comprising: a needle selection arrangement movable along said needle bed, knitting needles arranged in channels of the needle bed, and selector drivers or a tandem arrangement of working drivers and selector drivers positioned adjacent the knitting needles in the needle channels to cooperate with the needle selection arrangement, wherein the width of the working driver and/or selector driver is smaller than the width of the needle channels, and distance plates are inserted in the needle channels and fixed on at least one side of the drivers and extend substantially along the length of the working drivers and/or selector drivers and have a width equal to the difference between the width of the needle channels and the width of the working drivers and/or selector drivers.

2. Flat knitting machine according to claim 1 wherein the width of the needle channels and the knitting needles is constructed according to the gauge of the flat knitting machine, the width of the working driver and/or selector driver is uniformly constant, and the width of the distance plates is accordingly different for differing gauges of the flat knitting machine.

3. Flat knitting machine according to claim 1 wherein the surface of the distance plates extend in and beneath the surface of the needle bed.

4. Flat knitting machine according to claim 1, wherein a single distance plate is inserted along the length of each working driver and selector driver in the needle bed.

5. Flat knitting machine according to claim 1 wherein each distance plate is fixed in a form-locking manner against motion in the movement direction of the working driver and/or selector driver by means of a rail extending transversely of the needle channels in the needle bed.

6. Flat knitting machine according to claim 1 wherein the distance plate partially overlaps the knitting needles in the region of the operating or selector drivers.

7. Flat knitting machine according to claim 1 wherein distance plates are inserted on one side of the working driver and/or selector driver.

8. Flat knitting machine according to claim 1 wherein distance plates are inserted on both sides of the working driver and/or selector driver.

9. Flat knitting machine according to claim 1 wherein for gauge E3 of the flat knitting machine the width of the knitting needles is 2.2 mm, the width of the working driver and/or selector driver is 1 mm and the width of the distance plates is 1.2 mm.

* * * * *